US008393927B1

(12) United States Patent
Schinke

(10) Patent No.: US 8,393,927 B1
(45) Date of Patent: Mar. 12, 2013

(54) MARKER BUOY

(76) Inventor: Mark Schinke, Markesan, WI (US)

( * ) Notice: Subject to any disclaimer, the term of this patent is extended or adjusted under 35 U.S.C. 154(b) by 364 days.

(21) Appl. No.: 12/730,365

(22) Filed: Mar. 24, 2010

Related U.S. Application Data

(60) Provisional application No. 61/166,271, filed on Apr. 3, 2009.

(51) Int. Cl.
*B63B 22/16* (2006.01)

(52) U.S. Cl. ..... 441/6; 441/11; 441/23; 441/26

(58) Field of Classification Search ..... 441/6, 11, 441/21, 22, 23, 24, 25, 26, 28, 29
See application file for complete search history.

(56) References Cited

U.S. PATENT DOCUMENTS 2,722,019 A * 11/1955 Brock ..... 441/26
3,005,215 A * 10/1961 Colt et al. ..... 441/26
4,103,379 A * 8/1978 Wolfe ..... 441/11
4,224,707 A * 9/1980 Mariani ..... 441/11
4,781,636 A * 11/1988 Schurr ..... 441/6
5,403,219 A * 4/1995 Ryan ..... 441/11
5,865,656 A * 2/1999 Sims ..... 441/6

OTHER PUBLICATIONS

Jugit, as viewed on the website http://www.jugit.com/index on Nov. 15, 2010 (1 page).

* cited by examiner

*Primary Examiner* — Lars A Olson
(74) *Attorney, Agent, or Firm* — Brannen Law Office, LLC

(57) ABSTRACT

According to one preferred embodiment, the present invention can have a housing with a cap on one end. A flag support and a flag can project from the cap. A sleeve can be movable between the ends of the housing. A mechanical assembly is contained within the housing, and includes a rod, a plug, a tensioner and a reel. The tensioner can control the amount of tension on a line that is dispensed from the marker buoy. The line self-dispenses under the load of a weight connected to the line. The sleeve, operable in a first position, helps to maintain a vertical orientation of the housing within the water. Yet, the sleeve in a second position can prevent unwinding of the reel and maintain the flag in a storage position.

13 Claims, 3 Drawing Sheets

MARKER BUOY

This application claims priority on U.S. Provisional Application having application No. 61/166,271, filed on Apr. 3, 2009, the entire disclosure of which is hereby incorporated herein by reference.

FIELD OF THE INVENTION

The present invention relates to marker buoys, and in particular marker buoys that are preferably vertically oriented in the water, have adjustable tensioning lines, and that prevent buoy migration.

DESCRIPTION OF THE RELATED ART

Marker buoys are commonly used to mark the location within a body of water. Some examples include:

JUGIT Marker Buoy—This buoy is designed with a solid foam core with a polyurea coating. This buoy can be described as a cork, as it appears designed to float on top of the water.

A second type of design can have an exterior structure that rotates in the water while the weight descends from the buoy. The buoy will unwind under the force of the descending weight until the weight hits the bottom. One potential drawback of this design is that as the buoy rides on top of the water, excess line can be dispensed, and the marker can migrate.

Neither of these designs are vertically oriented in the water, wherein a flag can be seen a selected distance away from the marker.

Neither of these designs teaches a variable tension drive device to adjust the tension in the line.

Neither of these designs is designed to temporarily bob under the water during a wave event. The prior art, by constantly floating on top of the water, is subject to excess line being dispensed and migration issues.

Neither of these designs shows an external sleeve useful for buoyancy and for storage.

Thus there exists a need for a marker buoy that solves these and other problems.

SUMMARY OF THE INVENTION

The present invention relates to marker buoys, and in particular marker buoys that are preferably vertically oriented in the water, have adjustable tensioning lines, and that prevent buoy migration.

According to one preferred embodiment, the present invention can have a housing with a cap on one end. A flag support and a flag can project from the cap. A sleeve can be movable between the ends of the housing. A mechanical assembly is contained within the housing, and includes a rod, a plug, a tensioner and a reel. The tensioner can control the amount of tension on a line that is dispensed from the marker buoy. The line self-dispenses under the load of a weight connected to the line. The sleeve, operable in a first position, helps to maintain a vertical orientation of the housing within the water. Yet, the sleeve in a second position can prevent unwinding of the reel and maintain the flag in a storage position.

According to one advantage of the present invention, the marker remains vertical in the water. This is advantageously accomplished with the sleeve being positioned in a first position. The buoyancy of the sleeve causes the housing to vertically orient within the water and causes the flag to project upwards from the water. The marker accordingly can be located even a great distance from the user and nevertheless remain in sight.

According to another advantage of the present invention, the flag can be stored adjacent the outside of the housing. This is accomplished by moving the sleeve to a second position near the second end of the housing. The end of the flag support can then be secured between the sleeve and the housing.

Related, when the sleeve is in the second position, the sleeve prevents or restricts unwinding of the reel. This is accomplished by having the line be frictionally held between the housing and the sleeve.

According to a further advantage of the present invention, the housing is designed to cut through the waves as opposed to always riding on top of the water. This is advantageous as it prevents unnecessary amounts of line from being dispensed. Technically, the buoyant force of the sleeve is sufficient to cause the marker to float. However, in a wave condition, the addition of the tension force from the line being held by the weight is sufficient to cause the buoy to ride under the water temporarily and eliminate the need for dispensing of additional line. Migration of the marker is therefore prevented.

According to a still further advantage of the present invention, the tension of the line is adjustable. In one embodiment, a nut is used to compress a spring and add friction to the reel. The selected amount of friction will cause a selected amount of line tension.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with one or more preferred embodiments, it will be understood that it is not intended to limit the invention to that or those embodiments. On the contrary, it is intended to cover all alternatives, modifications and equivalents as may be included within the spirit and scope of the invention as defined by the appended claims.

Figure 1:
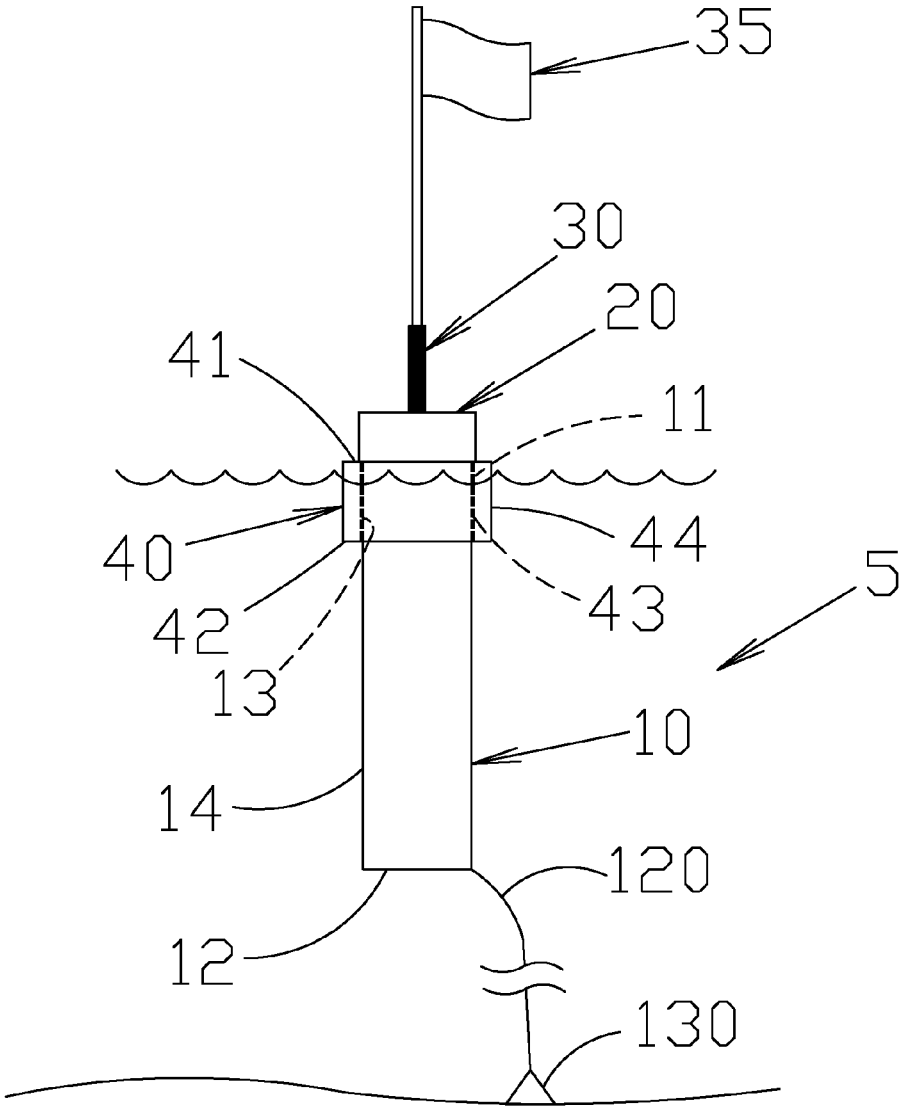
FIG. 1 is a side view of an embodiment of the present invention suspended in the water.
Figure 2:
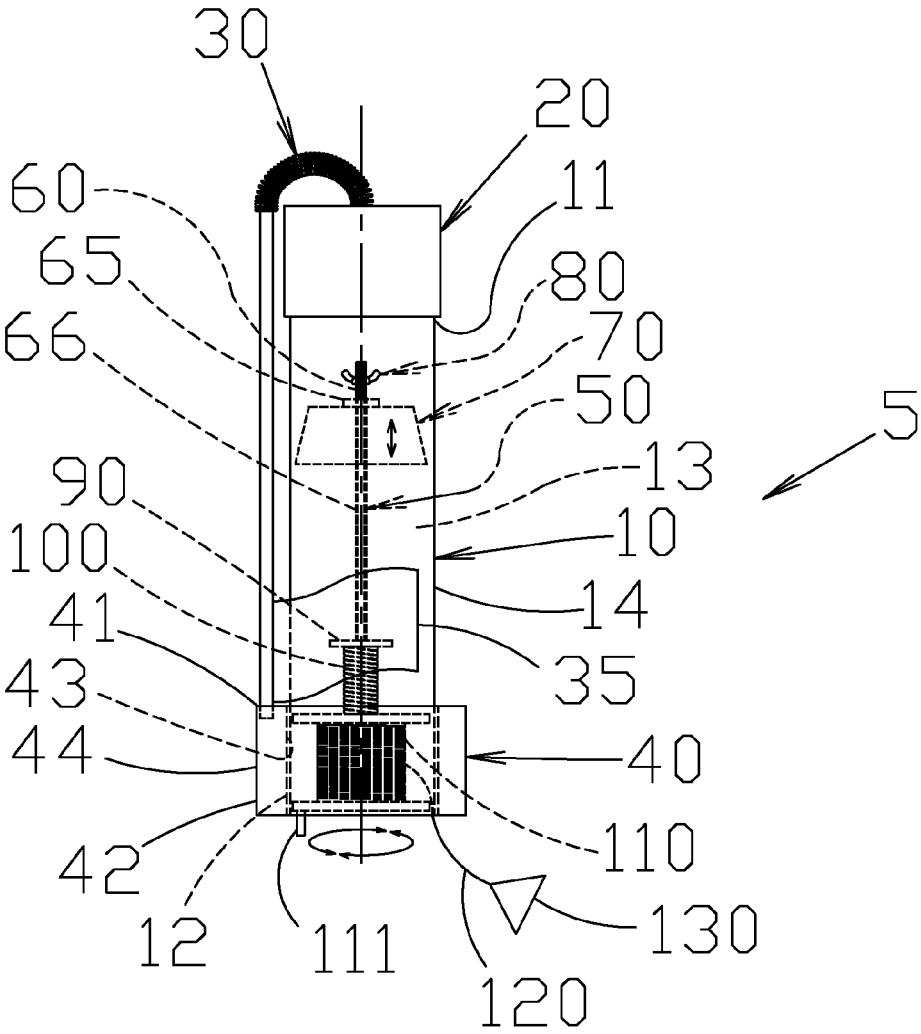
FIG. 2 is side view of the embodiment shown in FIG. 1 shown in a storage position.
Figure 3:
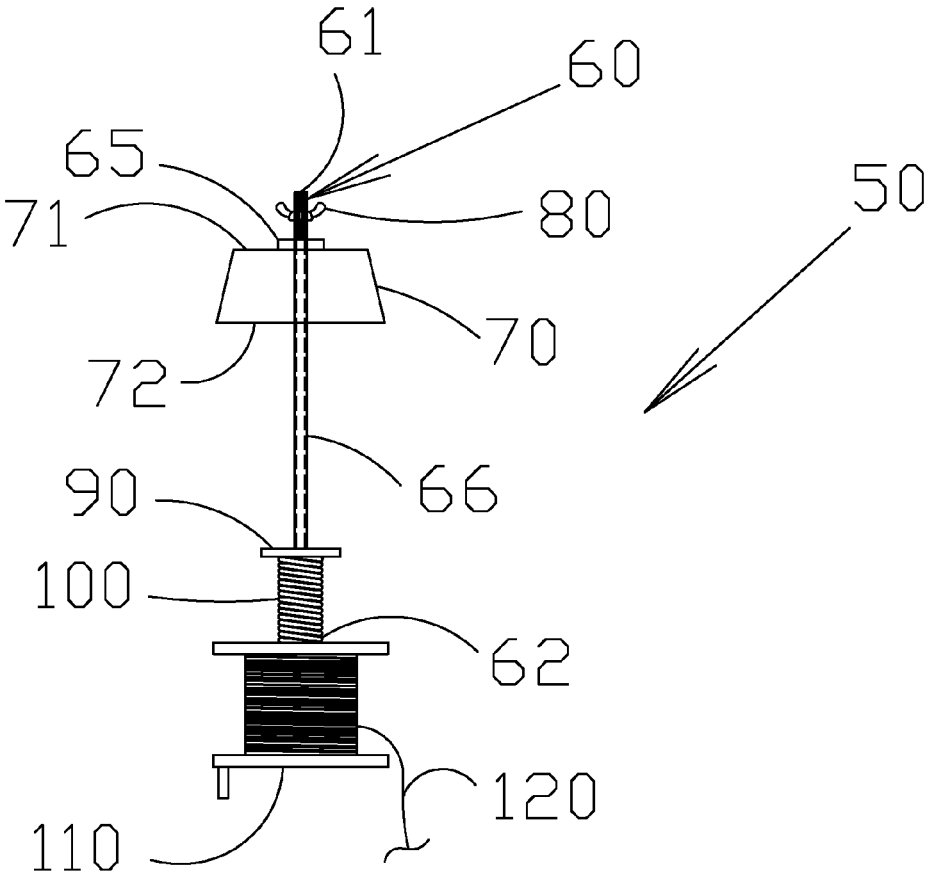
FIG. 3 is a side view of a preferred embodiment of a mechanical assembly of the present invention.

Turning to FIGS. 1-3, it is seen that a preferred embodiment of a buoy marker 5, or simply a marker, is illustrated. The marker 5 has a housing 10, a cap 20, a flag support 30 and a flag 35, a sleeve 40, a mechanical assembly 50, a line 120 and a weight 130. Each of these components is described below.

The housing 10 has a first end 11 and a second end 12, an inside 13 and an outside 14. The housing preferably has a generally circular interior profile, such as the one found on the inside of a tube or pipe. One preferred material is plastic. It is understood that other dimensions and materials can be used without departing from the broad aspects of the present invention. Several relatively small holes can be formed through the housing wall.

A cap 20 is also provided, and is designed to be removably connected to the first end 11 of the housing. In the illustrated embodiment, the cap is friction fit over the outside 14 of the housing. However, it is understood that other structures may be used without departing from the broad aspects of the present invention.

A flag support 30 with a flag 35 attached thereto is further provided. The flag support 30 has a longitudinal axis, and has a spring on one end that is bendable. The spring can be contorted such that the flag support 30 can be bent approximately 180 degrees from its normal longitudinal axis. The flag support 30 is biased to return to an orientation along its longitudinal axis. The flag 35 can be a standard flag made of plastic or other suitable material, and preferably is colored to have relatively high visibility.

A sleeve 40 is provided, and is movable upon the outside 14 of the housing 10. The sleeve 40 has a first end 41 and a second end 42, and also has an inside 43 and an outside 44. The sleeve 40 is preferably made of a foam or other buoyant material. Sleeve 40 can be in a first position at the first end 11 of the housing, or in a second position at the second end 12 of the housing. When the sleeve 40 is in the first position, the flag support, or flag assembly, can preferably be generally parallel to the longitudinal axis of the housing 10. The flag support 30 can be stored wherein an end of the flag assembly is tucked between the inside 43 of the sleeve and the outside 14 of the housing when the sleeve is in the second position.

The mechanical assembly 50 is removably received within the inside 13 of the housing. The mechanical assembly preferably comprises a rod 60 with a first end 61 and a second end 62, a know 65, a shaft 66, a plug 70 with a first end 71 and a second end 72, a nut 80, a disk 90, a spring 100 and a reel 110 having a manual crank 111.

The plug 70 is preferably sized so that it snugly fits within the housing. Nut 80, which can be a wing nut, can be tightened onto rod 60 to compress the plug 70 towards the disk 90. Movement of the disk 90 towards or away from the spring 100 determines the amount of friction between the spring 100 and the reel 110. The friction of the reel 110 determines the amount of tension in a line 120 that is dispensed from the reel. It is preferable that the plug 70 is located between the holes through the housing and the first end of the housing 10. The holes allow air to escape and for water to enter the bottom of the housing 10.

A weight 130 or other device can be connected to the line 120. The line can automatically dispense from the marker 5 until the weight 130 or other device contacts the ground or water body bed. It is preferably that the friction force between the spring and the reel is less than the force of the weight, so that the weight can freely descend under the force of gravity. However, the tension force caused by friction between the spring and the reel is preferably significant enough to prevent unnecessary unwinding of the line 120 to prevent marker migration.

During operation, the marker 5 is preferably vertically oriented within the water. The flag is suspended above the water by the flag support 30. The buoyancy of the marker is provided by the sleeve. However, the marker preferably cuts through the water during a wave condition as opposed to always floating on top of the water.

The line 120 can be rewound onto the reel 110 by operating the crank 111. In one embodiment, clockwise rotation of the crank 111, or spool, is used to wind the line onto the reel. Placing a small amount of tension on the line 120 (for example, by pinching between a finger and thumb) can be helpful when winding the line in.

For storage, a portion of the flag support 35 is held between the sleeve second end 42 and the outside of the housing 10, and the line is frictionally prevented from unspooling or unwinding because a portion of the line is engaged between the first end 41 of the sleeve and the outside 14 of the housing 10.

Thus it is apparent that there has been provided, in accordance with the invention, a marker buoy that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A marker buoy comprising:

a housing comprising a tube having a tube inside and a tube outside;

a flag upstanding from said housing;

a line depending from said housing and having a line distal end;

a weight attached to said line distal end;

a mechanical assembly housed within said tube, said mechanical assembly comprising a shaft, a nut and a spring, wherein operation of said nut relative said shaft imparts a selected amount of spring force onto said spring to create the selected amount of tension on said line allowing said weight to unwind said line with a predetermined amount of tension; and a flotation device imparting a selected amount of buoyancy to said marker buoy, wherein the tension on said line due to said mechanical assembly prevents migration of said marker buoy.

2. The marker buoy of claim 1 wherein said mechanical assembly further comprises a plug, said plug engaging said inside of said tube to prevent movement of said plug within said tube.

3. The marker buoy of claim 1 wherein said flotation device is supported on the outside of said tube.

4. The marker buoy of claim 3 wherein said flotation device comprises a sleeve that engages the outside of said tube.

5. A marker buoy comprising:

a housing comprising a tube having a tube inside, a tube outside, a tube top and a tube bottom;

a line depending from said housing and having a line distal end;

a weight attached to said line distal end;

a mechanical assembly within said housing and allowing said weight to unwind said line with a variable amount of tension; and a flotation device comprising a sleeve wherein said sleeve is selectable positionable at said tube top imparting a selected amount of buoyancy to said marker buoy to vertically orient said marker buoy in a body of water, wherein the tension on said line due to said mechanical assembly prevents migration of said marker buoy.

6. The marker buoy of claim 5 wherein:

said marker buoy further comprises a flag support centrally aligned relative to said tube, said flag support supporting a flag;

said sleeve is also selectably positionable at said tube bottom wherein said sleeve prevents said line from deploying; and said flag support is bendable to a position adjacent said tube in a storage position wherein a portion of the flag support can be placed between said sleeve and said tube.

7. A marker buoy comprising:

a tube having a tube top, a tube bottom, a tube inside and a tube outside;

a line depending from said tube bottom and having a line distal end;

a weight attached to said line distal end;

a mechanical assembly within said tube and allowing said weight to unwind said line with a variable amount of tension; and a sleeve connected to said tube outside imparting a selected amount of buoyancy to said marker buoy, wherein:

said sleeve is positionable at a first position adjacent said tube top, wherein said tube depends from said sleeve within a body of water and said tube is vertically oriented within said body of water, and said sleeve is positionable at a second position adjacent said tube bottom, wherein said sleeve interferes with the unwinding of said line.

8. The marker buoy of claim 7 further comprising a flag support supporting a flag, wherein:

said flag support vertically upstands from said tube in a deployed position; and said sleeve holds said flag support adjacent said tube outside in a storage position.

9. A marker buoy comprising:

a housing comprising a tube having an inside, an outside a tube top and a tube bottom;

a flag upstanding from said housing;

a line depending from said housing and having a line distal end;

a weight attached to said line distal end;

a mechanical assembly allowing said weight to unwind said line with a predetermined amount of tension; and a flotation device comprising a sleeve that is selectably positionable at said tube top imparting a selected amount of buoyancy to said marker buoy to vertically orient said barker buoy in a body of water, wherein said sleeve engages the outside of said tube and is supported on the outside of said tube, wherein the tension on said line due to said mechanical assembly prevents migration of said marker buoy.

10. The marker buoy of claim 9 wherein said sleeve is also selectably positionable at said tube bottom wherein said sleeve prevents said line from deploying.

11. The marker buoy of claim 10 further comprising a cap connected to said tube and a flag support, said flag support being connected to said cap and centrally aligned relative said tube in a deployed position and adjacent said tube in a storage position.

12. The marker buoy of claim 11 wherein said flag support is held adjacent said tube in a storage position by being between said tube and said sleeve.

13. A marker buoy comprising:

a tube having a tube top, a tube bottom, a tube inside and a tube outside, said tube having a plurality of holes there through adjacent said tube bottom to allow water to enter said tube inside;

a line depending from said tube bottom and having a line distal end;

a weight attached to said line distal end;

a mechanical assembly within said tube and allowing said weight to unwind said line with a variable amount of tension; and a sleeve connected to said tube outside imparting a selected amount of buoyancy to said marker buoy.

* * * * *